United States Patent [19]

Kato et al.

[11] 4,319,511

[45] Mar. 16, 1982

[54] TONE SOURCE FOR AN ELECTRONIC MUSICAL INSTRUMENT

[75] Inventors: Hiroshi Kato, Ageo; Toshio Mishima, Kitamoto, both of Japan

[73] Assignee: Kabushiki Kaisha Kawai Gakki Seisakusho, Hamamatsu, Japan

[21] Appl. No.: 251,810

[22] Filed: Apr. 7, 1981

Related U.S. Application Data

[63] Continuation of Ser. No. 953,923, Oct. 23, 1978, abandoned.

[30] Foreign Application Priority Data

Nov. 5, 1977 [JP] Japan ..... 52-132832

[51] Int. Cl.[3] ..... G10H 1/06

[52] U.S. Cl. ..... 84/1.22; 84/1.01

[58] Field of Search ..... 84/1.01, 1.19, 1.22, 84/1.11, DIG. 11

[56] References Cited

U.S. PATENT DOCUMENTS

| | | | |
|---|---|---|---|
| 3,603,809 | 9/1971 | Uchiyama | 84/1.22 |
| 3,636,231 | 1/1972 | Schrecongost et al. | 84/1.11 |
| 3,835,236 | 9/1974 | Adachi | 84/1.11 |
| 4,056,033 | 11/1977 | Inoue | 84/1.01 |
| 4,083,286 | 4/1978 | Faulkner | 84/1.01 |
| 4,116,102 | 9/1978 | Tsunoo et al. | 84/1.01 |
| 4,226,157 | 10/1980 | Klaiber et al. | 84/1.22 |

FOREIGN PATENT DOCUMENTS 2221336 11/1973 Fed. Rep. of Germany .

OTHER PUBLICATIONS

Simonton, "Portable Mini-Organ", Radio-Electronics, Jan. 1977, pp. 31-34.

*Primary Examiner*—J. V. Truhe
*Assistant Examiner*—Forester W. Isen

[57] ABSTRACT

A tone source circuit for electronic musical instruments which enables the selection of a desired one of a plurality of waveshapes of different duty ratios and is suitable for fabrication as an integrated circuit. The tone source circuit is composed of a tone signal generator for producing a tone signal of a frequency corresponding to each tone, a frequency divider group for frequency dividing the tone signal to a plurality of stages in a sequential order, a waveshape forming circuit for obtaining a plurality of waveshapes of different duty ratios from output signals of the frequency dividing stages of the frequency divider group and/or a feet select circuit for selecting a plurality of combinations of frequency dividing stages of the frequency divider group, waveshape select means for selecting a desired waveshape from the plurality of waveshapes of different duty ratios and means for selectively deriving a signal of the selected waveshape in response to key depression.

1 Claim, 9 Drawing Figures

TONE SOURCE FOR AN ELECTRONIC MUSICAL INSTRUMENT

This is a continuation of application Ser. No. 953,923 filed Oct. 23, 1978, now abandoned.

BACKGROUND OF THE INVENTION

1. Field of the Invention

This invention relates to a tone source circuit for electronic musical instruments which permits the selection of a desired one of a plurality of waveshapes of different duty ratios and is suitable for fabrication as an integrated circuit.

2. Description of the Prior Art

For simultaneously obtaining a plurality of feet ratios, for example, 4', 8' and 16' with a tone source circuit of conventional electronic musical instruments, not only a keyboard circuit requires complicated link wiring but also multi-pole key switches are necessary, resulting in the manufacture becoming troublesome and hence costly. Further, since a variety of tones are usually formed with one kind of waveshape such as a symmetrical rectangular wave, fidelity of tones of stringed instruments which include many high-frequency components is unsatisfactory in some cases. To avoid this, there has been proposed a method of obtaining tones of stringed instruments by making stairstep waves, but this method has the defect of complicated circuit construction including resistors, a mixing circuit, etc.

SUMMARY OF THE INVENTION

An object of this invention is to provide a tone source circuit for electronic musical instruments which enables the selection of a desired waveshape from a plurality of waveshapes of different duty ratios and is suitable for fabrication as an integrated circuit.

Another object of this invention is to provide a tone source circuit for electronic musical instruments which readily provides a desired combination of feet ratios and is suitable for fabrication as an integrated circuit.

The above objective is achieved by providing a tone source circuit for electronic musical instruments which is composed of a tone signal generator for producing a tone signal of a frequency corresponding to each tone, a frequency divider group for frequency dividing the tone signal to a plurality of stages in a sequential order, a waveshape forming circuit for obtaining a plurality of waveshapes of different duty ratios from output signals of the frequency dividing stages of the frequency divider group and/or a feet select circuit for selecting a plurality of combinations of frequency dividing stages of the frequency divider group, waveshape select means for selecting a desired waveshape from the plurality of waveshapes of different duty ratios and means for selectively deriving a signal of the selected waveshape in response to key depression.

DESCRIPTION OF PREFERRED EMBODIMENTS

Figure 1:
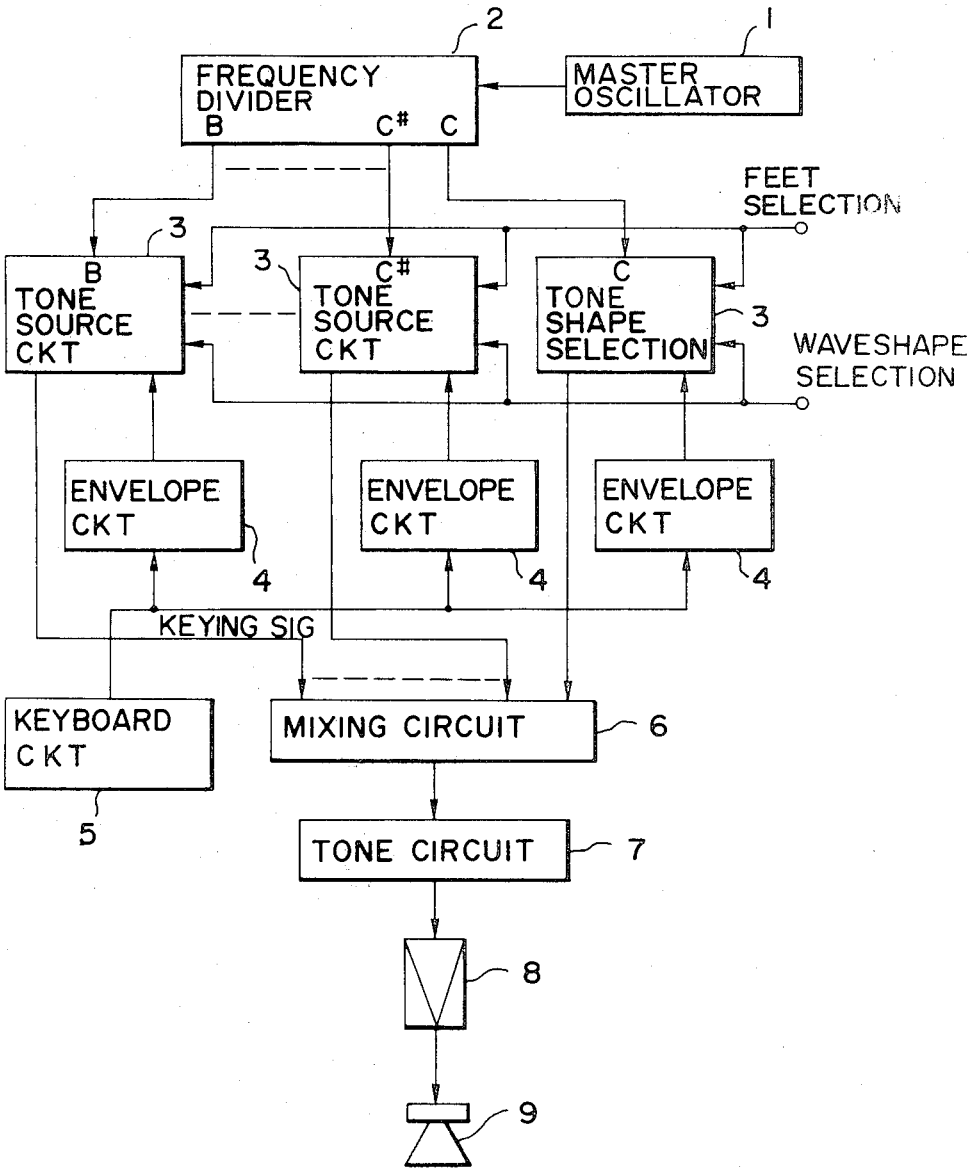
FIG. 1 is a block diagram illustrating the entire construction of an electronic musical instrument including the tone source circuit of this invention.

In FIG. 1, a signal generated by a master oscillator 1 is frequency divided by a frequency divider 2 to the highest frequencies of notes C through B. Signals having the frequencies respectively corresponding to the notes are then provided to tone source circuits 3 respectively corresponding to the notes. The tone source circuits 3 are each composed of a frequency divider group for frequency dividing the input signal down to $\frac{1}{2}$ in a sequential order, a feet select circuit for controlling the number of frequency dividing stages of the frequency divider group in accordance with a preset feet select signal, a waveshape forming circuit for obtaining three kinds of waveshapes of different duty ratios from the output signal derived from the frequency dividing stages, a waveshape select circuit for presetting one of the three kinds of waveshapes of different duty ratios and an analog gate circuit for deriving the signal selected by the waveshape select circuit by a keying signal which is provided by key depression from a keyboard circuit 5. That is, the tone source circuit 3 of this invention has two functions by a "structure for obtaining a combination of feet ratios" and a "structure for selecting waveshapes of different duty ratios". It is also possible to change the keying signal by an envelope circuit 4 to a signal of a desired envelope for controlling the analog gate circuit to obtain a tone signal corresponding to the envelope. The tone signal derived from the tone source circuit 3 in response to key depression is applied to a speaker 9 via a mixing circuit 6, a tone circuit 7 and an amplifier circuit 8.

Figure 2:
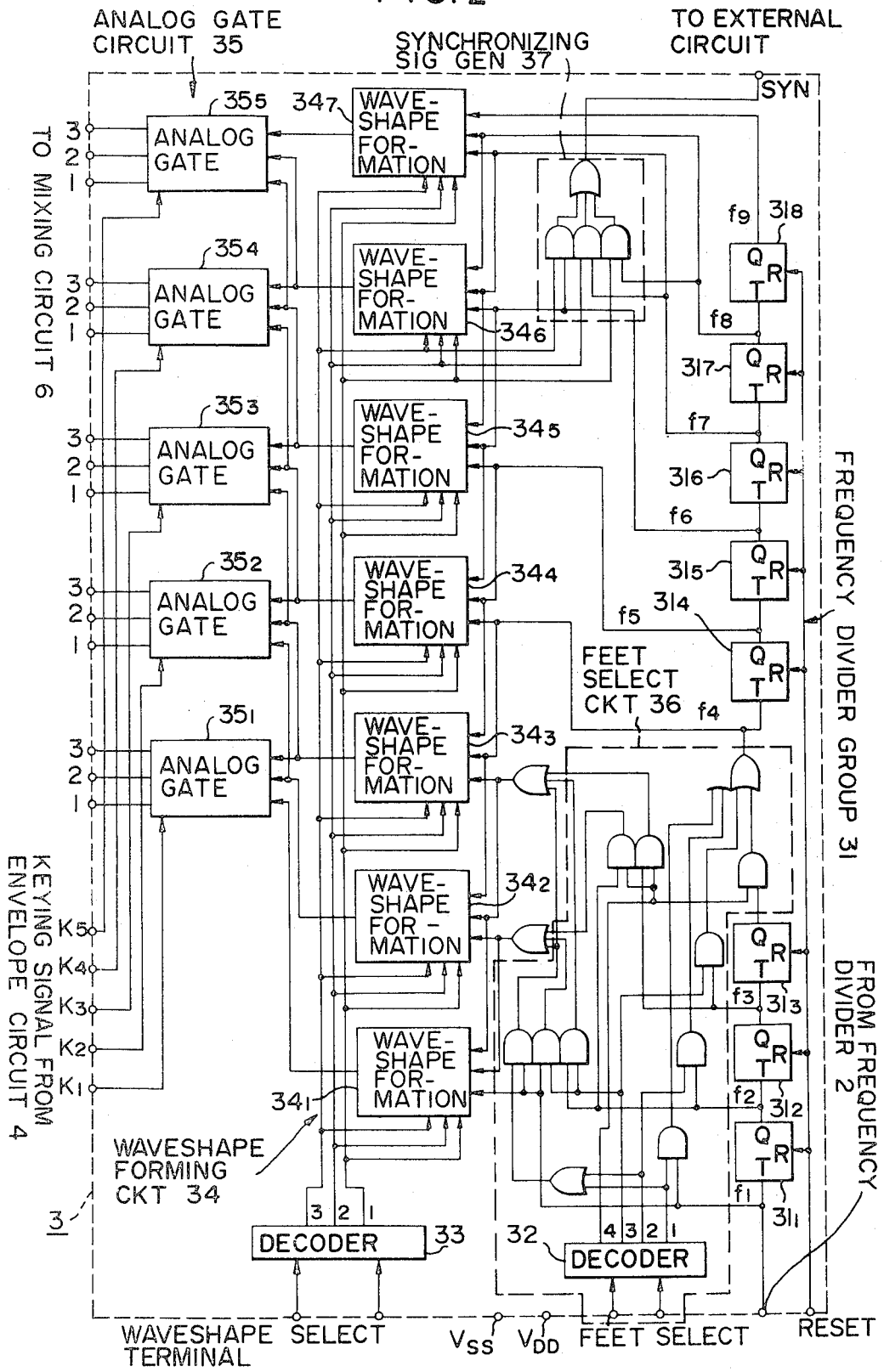
FIG. 2 is a connection diagram showing in detail the construction of an embodiment of the tone source circuit of this invention.

FIG. 2 shows in detail the construction of a specific operative example of the tone source circuit 3 of this invention in FIG. 1. In FIG. 2, each note signal from the frequency divider 2, for example, the signal having the highest frequency of the note C is sequentially frequency divided by a frequency divider group 31 composed of T flip-flops $\mathbf{31}_1$ through $\mathbf{31}_8$ down to $\frac{1}{2}$. The number of frequency dividing stages is controlled by a preset feet select signal, and signals of such frequencies as shown in Table 1 are each provided by depression of key switches $K_1$ through $K_5$ from an analog gate 35 (gates $\mathbf{35}_1$ through $\mathbf{35}_5$). In Table 1, $K_1$ through $K_5$ indicate key switches which range over five octaves corresponding to the note C, and $f_1$ through $f_9$ indicate output frequencies which are derived from the respective stages of the frequency dividers 31 when all of them are in operation.

TABLE 1

| Key | | | | | | | | | | | | | | | | | | |
|---|---|---|---|---|---|---|---|---|---|---|---|---|---|---|---|---|---|---|
| $K_5$ | | | $K_4$ | | | $K_3$ | | | $K_2$ | | | $K_1$ | | | | | | feet |
| 3 | 2 | 1 | 3 | 2 | 1 | 3 | 2 | 1 | 3 | 2 | 1 | 3 | 2 | 1 | output | | | select |
| $f_6$ | $f_5$ | $f_4$ | $f_5$ | $f_4$ | $f_3$ | $f_4$ | $f_3$ | $f_2$ | $f_3$ | $f_2$ | $f_1$ | $f_2$ | $f_1$ | $f_1$ | 4' | 2' | 1' | 00 |

TABLE 1-continued

| Key | | | | | | | | | | | | | | | | | | |
|---|---|---|---|---|---|---|---|---|---|---|---|---|---|---|---|---|---|---|
| $K_5$ | | | $K_4$ | | | $K_3$ | | | $K_2$ | | | $K_1$ | | | | | | feet |
| 3 | 2 | 1 | 3 | 2 | 1 | 3 | 2 | 1 | 3 | 2 | 1 | 3 | 2 | 1 | output | | | select |
| $f_7$ | $f_6$ | $f_5$ | $f_6$ | $f_5$ | $f_4$ | $f_5$ | $f_4$ | $f_3$ | $f_4$ | $f_3$ | $f_2$ | $f_3$ | $f_2$ | $f_1$ | 8′ | 4′ | 2′ | 01 |
| $f_8$ | $f_7$ | $f_6$ | $f_7$ | $f_6$ | $f_5$ | $f_6$ | $f_5$ | $f_4$ | $f_5$ | $f_4$ | $f_3$ | $f_4$ | $f_3$ | $f_2$ | 16′ | 8′ | 4′ | 10 |
| $f_9$ | $f_8$ | $f_7$ | $f_8$ | $f_7$ | $f_6$ | $f_7$ | $f_6$ | $f_5$ | $f_6$ | $f_5$ | $f_4$ | $f_5$ | $f_4$ | $f_3$ | 32′ | 16′ | 8′ | 11 |

As is seen from the above table, for a musical instrument from which the player is going to simultaneously produce tones having feet ratios of 2′, 4′ and 8′, use is made of a tone source circuit whose feet select element is set to "01". In the case of obtaining feet ratios 1′, 2′, 4′, 8′, 16′ and 32′, two kinds tone source circuits whose feet select terminals are respectively set to "00" and "11" are employed. In this manner, a desired combination of a plurality of feet ratios can be easily obtained.

The output signal frequency divided by the frequency divider group 31 is provided to a waveshape forming circuit 34 (circuits $34_1$ through $34_7$) for obtaining three kinds of waveshapes of different duty ratios. A desired one of the three kinds of waveshapes can be selected by previously applying a select signal to a waveshape select terminal.

Figure 3A:
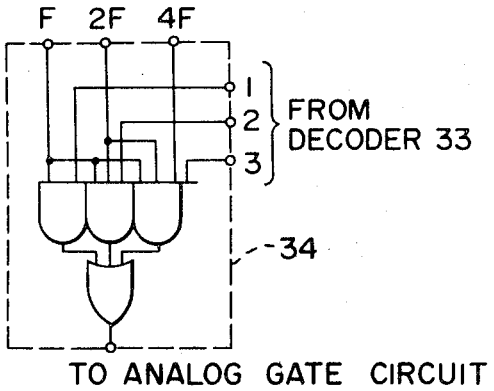
FIGS. 3A, 3B and 4 respectively show specific operative examples of a waveshape forming circuit and an analog gate circuit utilized in the embodiment of FIG. 2.
Figure 3B:
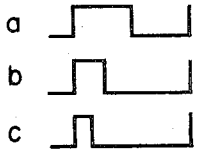

FIG. 3A illustrates a specific operative example of the waveshape forming circuit 34. By providing to three input terminals frequencies F, 2F and 4F from the frequency divider group 31 which are displaced one octave apart, there can be produced such three kinds of waveshapes a, b and c as shown in FIG. 3B which have different duty ratios. Only one of the three waveshapes is selected by a signal 1, 2 or 3 derived from a decoder 33 which decodes an input signal from the waveshape select terminal. For example, in the case of producing a tone of a flute, the waveshape select terminal is preset to "00" so as to obtain the waveshape a, and in the case of producing a tone of a stringed instrument, the waveshape select terminal is similarly preset to obtain the waveshape c. In such cases, two IC's for the tones of a flute and a stringed instrument are used for one tone. It will be evident that this ensures to make the tone of a stringed instrument sound like a tone actually produced by a stringed instrument. When one IC is used for one tone in a simple and inexpensive model of an electronic musical instrument, the waveshape select terminal is preset to obtain the waveshape b. The provision of such a waveshape select terminal eliminates the necessity of making three kinds of IC's and enables IC's of one kind to be used in common to the three kinds of waveshapes. The tone signal from the waveshape forming circuit 34 (circuits $34_1$ through $34_7$) is provided to the analog gate circuit 35 (circuits $35_1$ through $35_5$) which permits the passage therethrough of the tone signal by the keying signal in response to the key depression.

Figure 4:
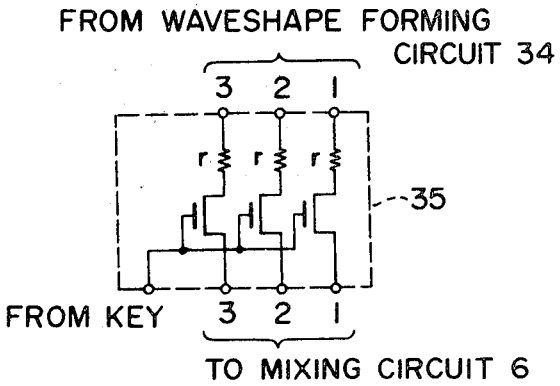

FIG. 4 illustrates a specific operative example of the analog gate circuit 35 ($35_1$ through $35_5$). As is seen from FIG. 4, one keying signal, for instance, $K_1$ opens the analog gate circuit $35_1$ to simultaneously provide signals of three kinds of feet ratios as shown. Consequently, one kind of switches may be used in place of three kinds of switches for producing three kinds of feet ratios as in the prior art, and complicated external link wiring is also unnecessary.

Figure 5A:
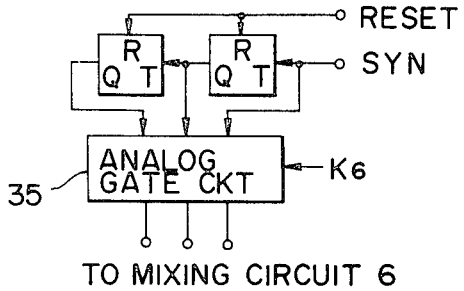
FIGS. 5A, 5B and 5C respectively illustrate associated external circuits connected with synchronizing signal generator 37 in FIG. 2.
Figure 5B:
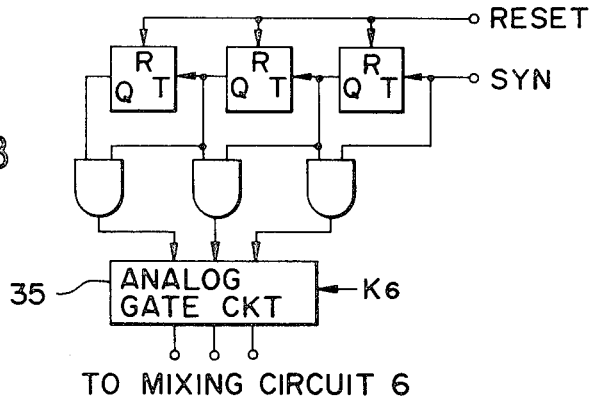
Figure 5C:
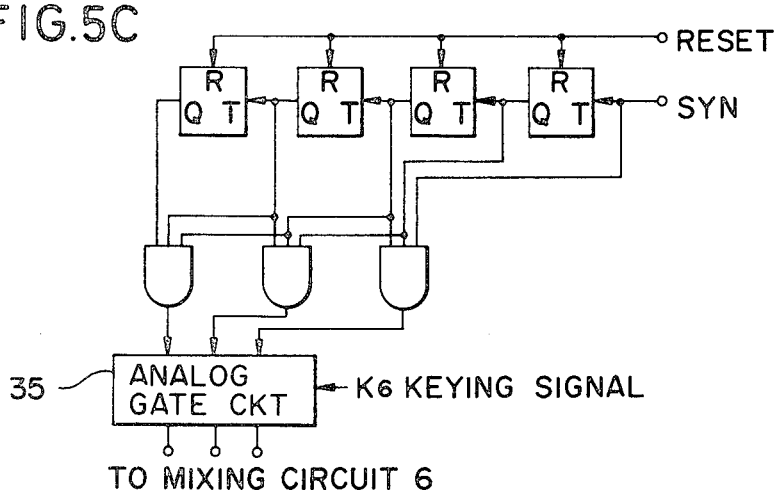

The arrangement of FIG. 2 produces waveshapes of five octaves from $C_1$ to $C_5$ by the closure of the key switches $K_1$ through $K_5$. In the case of a musical instrument having a keyboard of 61 keys, when twelve such IC's as shown in FIG. 2 are employed for C to B, a signal for one key lacks. Therefore, a signal from an appropriate frequency dividing stage of the frequency divider group is provided at a synchronizing signal terminal (SYN) from the synchronizing signal generator 37 in accordance with the waveshape selection. To the synchronizing signal terminal is selectively connected such circuits as depicted in FIGS. 5A, 5B and 5C. That is, these circuits are selectively connected to the abovesaid terminal in dependence upon whether the waveshape selection in FIG. 2 is preset for the waveshape a, b or c shown in FIG. 3B. As this is not the point of this invention, no detailed description will be given.

Reset terminals in FIGS. 2 and 5A, 5B and 5C are to reset the frequency divider group 31 ($31_1$ through $31_8$) at the time of connection of the power supply and are required for matching the phases of signals when two or more IC's are used for one tone, for instance, in the case of providing separate tone sources for a stringed instrument and a flute.

Figure 6:
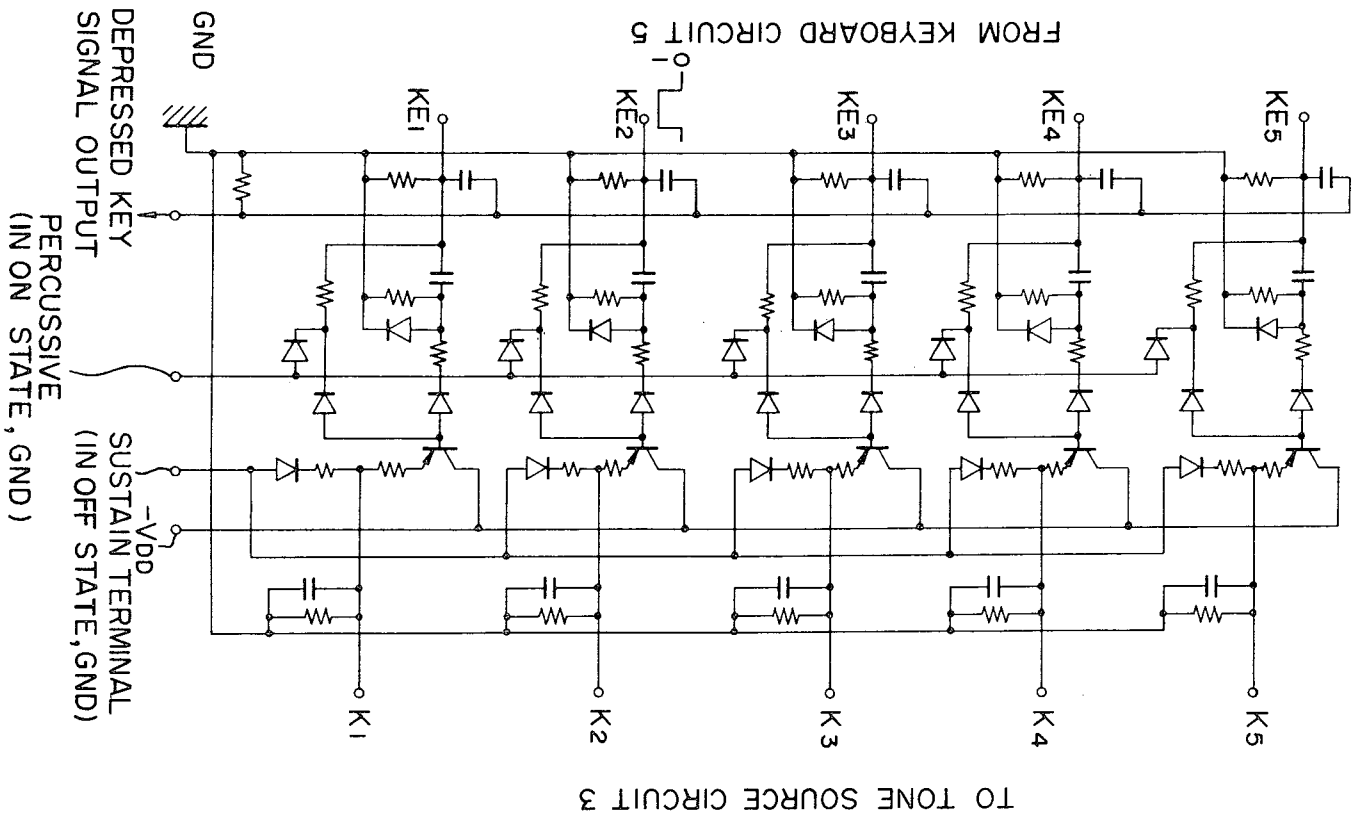
FIG. 6 shows a specific operative example of an envelope circuit 4 used in FIG. 1.

FIG. 6 illustrates a specific operative example of the envelope circuit 4 utilized in FIG. 1. This circuit adds a percussive and a sustain effect to depressed key signals $KE_1$ through $KE_5$ from the keyboard circuit 5 from a percussive and a sustain terminal. The keying signals $K_1$ through $K_5$ respectively given the above effects are each applied to the analog gate circuit 35 ($35_1$ through $35_5$) to provide a desired tone signal. In FIG. 6, a differentiated output from a depressed key signal output terminal is utilized as a synchro start signal for an automatic accompaniment instrument.

As has been described in the foregoing, according to this invention, desired various waveshapes are formed by a waveshape forming circuit which produces a plurality of waveshapes of different duty ratios from output signals of frequency dividing stages of a frequency divider group, whereby a waveshape of a desired tone of, for example, a stringed instrument can be obtained. In the present embodiment, three kinds of waveshapes are set, but also in the case of producing three kinds of waveshapes with one organ, there is no need of making three kinds of IC's and three IC's of this invention can be used.

Further, as described above in respect of the embodiment, a feet select circuit is provided at the input side of the waveshape forming circuit of this invention, and a plurality of combinations of frequency dividing stages of the frequency divider group is selected by an external terminal, by which a desired combination of feet ratios can be obtained. In the above embodiment, as four combinations of feet ratios can be preset, four kinds of IC's respectively having the combinations of feet ratios can be set, eliminating the necessity of making four kinds of IC's respectively having the combinations of feet ratios and enabling one kind of IC's to be used in common.

Thus, this invention makes it possible to use IC's of one kind for obtaining such different combinations of waveshapes and different combinations of feet ratios, without the necessity of making a plurality of kinds of IC's. Accordingly, the IC of the tone source circuit can be equally employed in electronic musical instruments of not only simple and inexpensive models but also complicated and expensive models.

It will be apparent that many modifications and variations may be effected without departing from the scope of the novel concepts of this invention.

What is claimed is:

1. A tone source circuit for an electronic musical instrument comprising:

a top octave generator circuit means for frequency dividing a signal from a main oscillator to produce tone signals which respectively represent the highest frequency of each of the tones C to B of a 12 tone musical scale;

a respective frequency divider group having frequency dividing stages in each group for each of said 12 tone signals for dividing the respective tone signals sequentially by 2 to obtain output tone signals having feet ratios selected from the group consisting of 1′, 2′, 4′, 8′, 16′, and 32′;

a feet select circuit means respectively selecting from each frequency divider group three tone signals, each of different feet ratios;

a waveshape circuit forming means forming a plurality of rectangular tone signal waveshapes of different duty ratios from said three tone signals;

a waveshape select circuit means controlling said waveshape circuit forming means to thereby select a rectangular tone signal waveshape of desired duty ratio; and gate circuit means delivering said selected rectangular tone signal waveshape in response to a key depression signal provided from a keyboard.

* * * * *